US009706896B2

(12) United States Patent
Hong et al.

(10) Patent No.: US 9,706,896 B2
(45) Date of Patent: Jul. 18, 2017

(54) DISHWASHER

(71) Applicant: SAMSUNG ELECTRONICS CO., LTD., Suwon-si (KR)

(72) Inventors: Kwan Woo Hong, Seoul (KR); Dae Uk Kang, Hwaseong-si (KR); Jeong Hoon Kang, Seoul (KR); Hooi Joong Kim, Yongin-si (KR); Chan Young Park, Suwon-si (KR); Chang Wook Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 230 days.

(21) Appl. No.: 14/564,184

(22) Filed: Dec. 9, 2014

(65) Prior Publication Data

US 2015/0182102 A1 Jul. 2, 2015

(30) Foreign Application Priority Data

Dec. 31, 2013 (KR) ..... 10-2013-0169566

(51) Int. Cl.

| | |
|---|---|
| ***A47L 15/16*** | (2006.01) |
| ***A47L 15/18*** | (2006.01) |
| ***A47L 15/42*** | (2006.01) |

(52) U.S. Cl.

CPC ..... *A47L 15/4282* (2013.01); *A47L 15/16* (2013.01); *A47L 15/18* (2013.01)

(58) Field of Classification Search

None

See application file for complete search history.

(56) References Cited

U.S. PATENT DOCUMENTS

| | | | | |
|---|---|---|---|---|
| 2,873,141 | A * | 2/1959 | Warnstrom | A47L 15/20 134/180 |
| 3,496,949 | A | 2/1970 | Mercer | |
| 5,944,037 | A | 8/1999 | Sinyong et al. | |
| 2013/0319487 | A1 * | 12/2013 | Hong | A47L 15/06 134/183 |

FOREIGN PATENT DOCUMENTS

| | | |
|---|---|---|
| DE | 102012103422 | 10/2013 |
| EP | 2 671 494 | 12/2013 |
| EP | 2 786 691 | 10/2014 |
| EP | 2 807 970 | 12/2014 |
| JP | 64-25065 | 2/1989 |
| JP | 2008-279137 | 11/2008 |

OTHER PUBLICATIONS

Extended European Search Report dated May 19, 2015 from European Patent Application No. 14199809.6, 6 pages.

* cited by examiner

*Primary Examiner* — Michael Barr
*Assistant Examiner* — Cristi Tate-Sims
(74) *Attorney, Agent, or Firm* — Staas & Halsey LLP

(57) ABSTRACT

A dishwasher having a spray unit fixed at a washing tub and configured to spray wash water, and a conversion assembly provided as to convert the direction of the wash water being sprayed from the spray unit toward a tableware basket. The conversion assembly includes a vane rotatably provided while disposed as to face with respect to the spray unit such that the direction of the converted wash water is adjusted. Through the structure as such, the spraying range of the wash water is extended, and may be able to minimize noise from the striking of the wash water against an inside wall or door of the dishwasher.

29 Claims, 14 Drawing Sheets

DISHWASHER

CROSS-REFERENCE TO RELATED APPLICATIONS

This application claims the benefit of the Korean Patent Application No. 10-2013-0169566, filed on Dec. 31, 2013, in the Korean Intellectual Property Office, the disclosure of which is incorporated herein by reference.

BACKGROUND

1. Field

Embodiments of the present disclosure relate to a dishwasher, and more particularly, a dishwasher having a spraying structure to enhance the spraying efficiency of wash water 2. Description of the Related Art In general, a dishwasher is an apparatus configured to wash tableware by spraying high-pressure wash water toward the tableware, and conventionally goes through pre-washing, main washing, rinsing, and drying stages. During the pre-washing stage, a stain on the tableware is removed by spraying the wash water without an input of detergent, and during the main washing stage, a cleaning of the tableware is enabled by spraying the wash water, and at the same time, by having the detergent input by use of a detergent supplying apparatus.

In general, the dishwasher includes a cabinet provided at an inside thereof with a washing tub, a tableware basket movably installed at an inside the washing tub such that the tableware basket is moved forward/backward, and a spray unit to spray the wash water toward the tableware basket, and the wash water sprayed from the spray unit is provided to wash the tableware.

The tableware basket includes an upper tableware basket provided at an upper portion of the washing tub, and a lower tableware basket provided at a lower portion of the washing tub. A conventional spray unit is positioned at an upper side of an upper tableware basket, and at an upper side and a lower side of a lower tableware basket. In a case when the spray unit is provided to be rotated, blind areas where the wash water being sprayed fails to reach the edges of the washing tub because the wash tub is in the shape of a rectangle.

To prevent the occurrence of the blind areas, it has been suggested to change the length of the spray unit or to include a structure configured such that the spray unit is rotationally moved. However, the above suggestion is only capable of preventing the occurrence of the blind areas at which the wash water is not reached, while scattered and concentrated washing effects are not being achieved.

In addition, in a case of a structure having the extended direction of the spray unit changed so that the wash water reaches the blind areas, when the direction of the spray unit is perpendicular with respect to a wall surface of the washing tub, the wash water is faced toward the wall surface of the washing tub, and thus, not only does the washing of the tableware not take place, but also noise is increased by the spray unit facing the wall surface.

Other than the above, in a case when the spray unit is fixed at the tableware basket, a flow path is less efficiently disposed, and the structure of the tableware basket is provided to be complex

SUMMARY

Therefore, it is an aspect of the present disclosure to provide a dishwasher capable of extending a spraying range of wash water by improving the structure of a conversion unit configured to convert a spray direction of the wash water.

Additional aspects of the disclosure will be set forth in part in the description which follows and, in part, will be obvious from the description, or may be learned by practice of the disclosure.

In accordance with one aspect of the present disclosure, a dishwasher includes a cabinet, a washing tub, a tableware basket, a spray unit, and a conversion assembly. The cabinet may form an exterior appearance of the dishwasher. The washing tub may be provided at an inside the cabinet, and allow washing of tableware to be taken place therein, The tableware basket may be configured to store the tableware at an inside the washing tub. The spray unit may be fixed to the washing tub and configured to spray wash water. The conversion assembly may be provided as to convert the direction of the wash water being sprayed from the spray unit toward the tableware basket. The conversion assembly may include a vane rotatably provided while disposed as to face the spray unit such that the direction of wash water converted is adjusted.

The vane may be formed in a first axis direction, which is lengthways direction, and may be provided as to axially rotate on the first axis.

The dishwasher may further include a guide rail provided such that the vane is parallelly moved in a second direction that is perpendicular to the first axis The vane may be provided so as to simultaneously perform an axial rotation while having the first direction as a center of rotation and a parallel movement in the second direction.

The vane may include a direction converting surface concaved at surface of the vane making contact with wash water so as to convert the direction of wash water sprayed from the spray unit toward the tableware basket.

An angle θ formed between the guide rail and the direction converting surface may vary with a position of the conversion assembly.

The dishwasher may further include rotation guides provided at both end portions of the guide rail such that the vane is axially rotated on the first axis.

The guide rail may include: a first section, which is a section in which the conversion assembly is rotated on the first axis by the rotation guide; and a second section, which is the remaining section, wherein the angle may be referred to as θ1 in the first section, and referred to as θ2 in the second section, wherein θ1 is smaller than θ2.

The first section may be disposed at each of both end portions of the second section.

The rotation guide may include a rotating inclination surface configured to press the conversion assembly such that the vane is axially rotated on the first axis in a gradual manner.

The rotation guide may include a first rotation guide disposed at one end portion of the guide rail; and a second rotation guide disposed at the other end portion of the guide rail.

The conversion assembly may further include a vane holder at which the vane is mounted, and which is provided so as to rotate on the first axis; and the rotation guide is configured to allow the vane to axially rotate on the first axis by pressing the vane holder.

The conversion assembly may further include: a guide holder provided such that the vane is moved in the second direction along the guide rail; and the vane holder is coupled to the guide holder so as to rotate on the first axis.

The conversion assembly may further include a vane holder at which the vane is mounted, and which is provided to be rotated on the first axis, and the vane holder comprises a front vane holder corresponding to the first rotation guide and disposed at a front of the vane; and a second vane holder corresponding to the second rotation guide and disposed at a rear of the vane.

The first rotation guide may include a first inclination surface which is inclined with respect to a moving direction of the vane such that the front vane holder ascends as the vane travels; and the second rotation guide comprises a second inclination surface which is inclined with respect to the moving direction of the vane such that the rear vane holder descends as the vane travels.

The dishwasher may further include a door configured to open/close an opening of the cabinet, wherein the first rotation guide may be configured to rotate the vane in a first rotating direction while having an upper end of the vane inclined toward a rear, such that the door is prevented from being struck by the wash water being sprayed from the spray unit.

The second rotation guide may be configured to rotate the vane in the first rotating direction such that the spraying range of the wash water being sprayed from the spray unit is widened.

The conversion assembly may be provided on at least one of an upper side or lower side of the tableware basket as to convert the direction of the wash water being sprayed from the spray unit toward the tableware basket.

In accordance with another aspect of the present disclosure, a dishwasher includes a cabinet, a washing tub, a spray unit, a conversion assembly, a guide rail and a rotation guide. The cabinet may form an exterior appearance of the dishwasher. The washing tub may be provided at an inside the cabinet and allow washing of tableware to be taken place therein. The spray unit may be fixed to the washing tub and configured to spray wash water. The conversion assembly may be provided to rotate on a first axis, may have a vane provided to face the spray unit such that the direction of the wash water being sprayed from the spray unit is converted, and may be movably provided. The guide rail may be provided such that the conversion assembly is moved in a second direction that is perpendicular to the first axis. The rotation guide may be capable of rotating the vane on the first axis.

The rotation guide, while disposed at one end portion of the guide rail, may be configured to allow the conversion assembly to rotate on the first axis in a case when the conversion assembly is moved toward the one end portion of the guide rail.

The conversion assembly may include: a vane holder provided as to rotate together with the vane, and provided to rotate on the first axis; and a guide holder provided such that the guide rail is moved in the second direction, and configured to support the vane holder.

The vane may include a direction converting surface configured to convert the direction of the wash water sprayed from the spray unit; and the direction converting surface may be inclinedly provided toward a rear of the washing tub by the rotation guide.

The guide rail may include: a first section, which is a section in which the conversion assembly is moved in between the rotation guides; and a second section, which is a section in which the conversion assembly is moved while being rotated on the first axis by the rotation guide, wherein an angle θ1 formed between the direction converting surface and the guide rail in the first section may be larger than an angle θ2 between the direction converting surface and the guide rail in the second section.

The second section may be disposed at each of both end portions of the first section.

The rotation guide may include a first rotation guide disposed at one end portion of the guide rail; and a second rotation guide disposed at the other end portion of the guide rail.

In accordance with another aspect of the present disclosure, a dishwasher include: a cabinet, a washing tub, a spray unit, a conversion assembly, and a guide rail. The cabinet may form an exterior appearance of the dishwasher. The washing tub may be provided at an inside the cabinet and allow washing of tableware to be taken place therein. The spray unit may be fixed to the washing tub and configured to spray wash water. The conversion assembly may be movably provided and disposed while facing the spray unit such that the direction of the wash water being sprayed from the spray unit is converted. The guide rail may be configured to guide movement of the conversion assembly, wherein the conversion assembly may include a guide holder provided to move along the guide rail; a vane holder provided at the guide holder as to be axially rotated; and a vane mounted at the vane holder and provided to be rotated together with rotation of the vane holder.

In accordance with another aspect of the present disclosure, a dishwasher include: a cabinet, a washing tub, a tableware basket, a spray unit, a guide rail and a conversion rail. The cabinet may form an exterior appearance of the dishwasher. The washing tub may be provided at an inside the cabinet and allow washing of tableware to be taken place therein. The tableware basket may be configured to store the tableware at an inside the washing tub. The spray unit may be provided to move while spraying wash water toward the tableware basket. The guide rail may be configured to guide movement of the spray unit. The conversion assembly may be configured to support the spray unit such that the spray unit is moved along the guide rail, and configured to rotatably support the spray unit such that the spray unit is rotated while having a length direction as a center of rotation

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
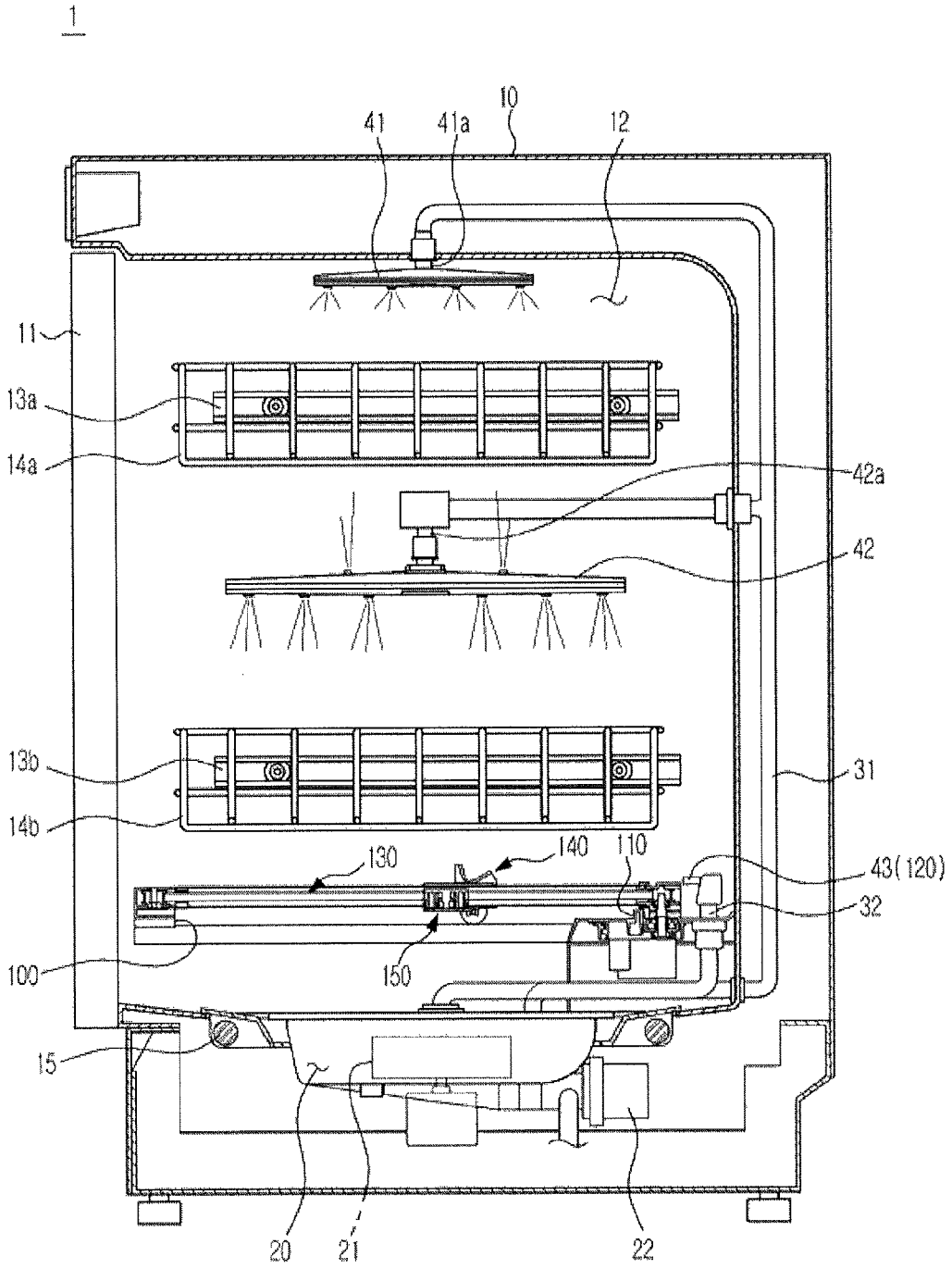
FIG. 1 is a cross-sectional view of a dishwasher in accordance with one embodiment of the present disclosure.

Reference will now be made in detail to the embodiments of the present disclosure, examples of which are illustrated in the accompanying drawings, wherein like reference numerals refer to like elements throughout.

Figure 2:
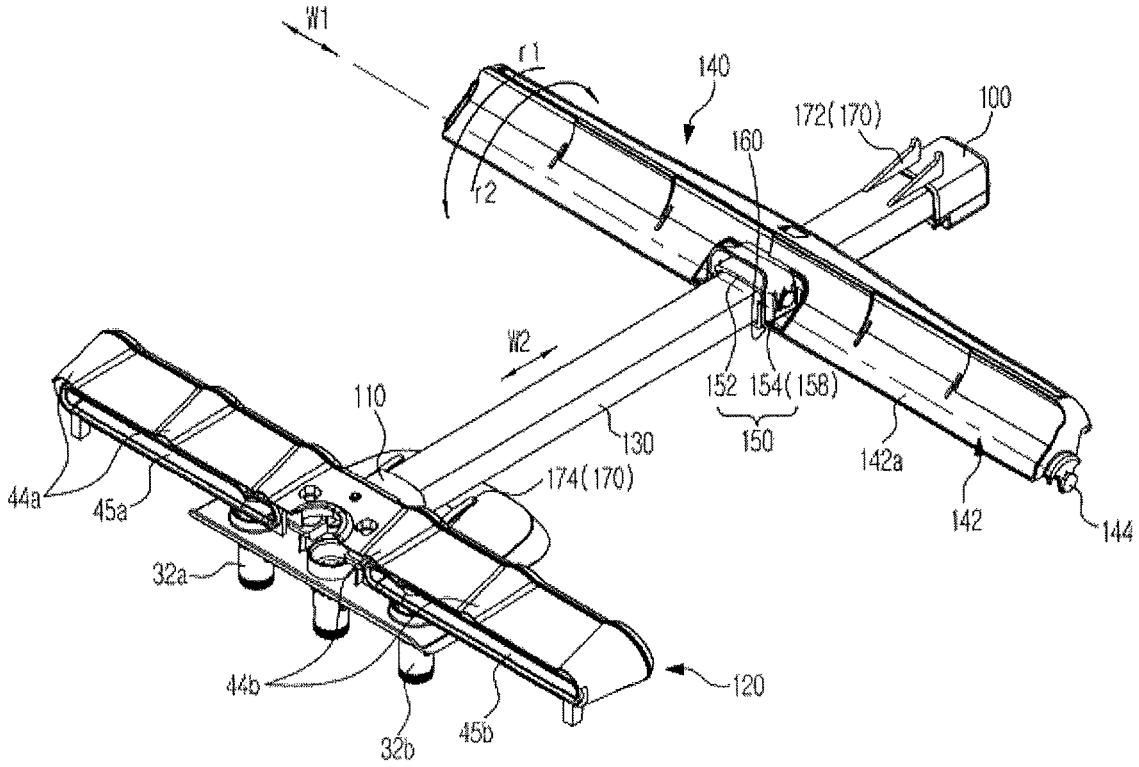
FIG. 2 and FIG. 3 are perspective views of a portion of a structure of the dishwasher in accordance with one embodiment of the present disclosure.
Figure 3:
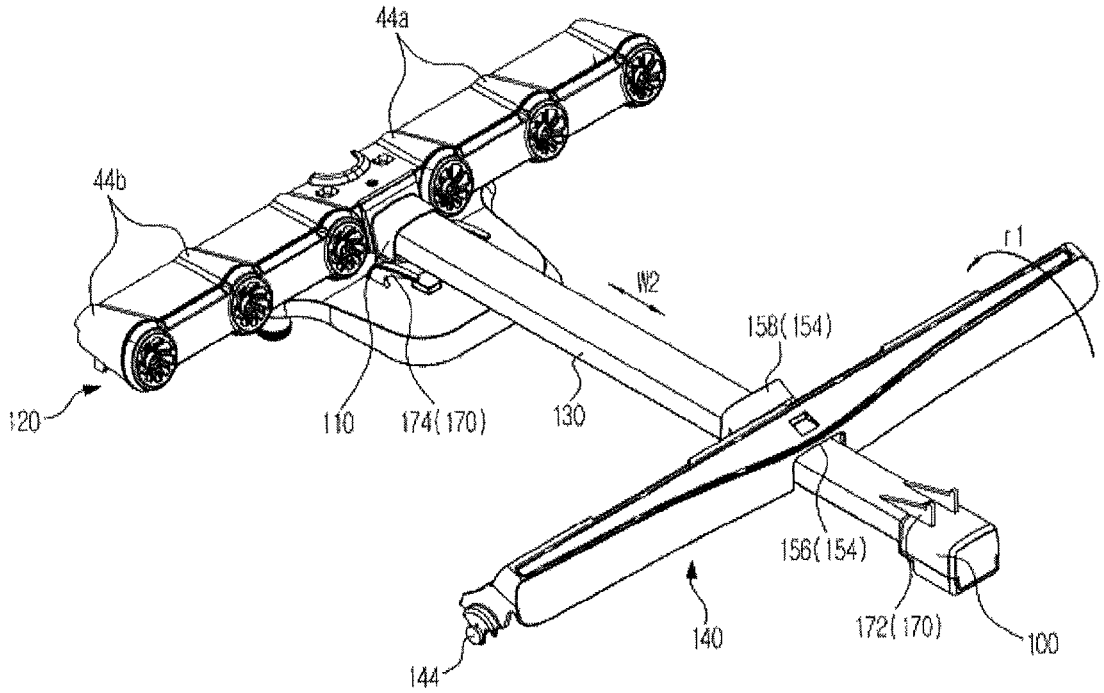

FIG. 1 is a cross-sectional view of a dishwasher in accordance with one embodiment of the present disclosure, and FIG. 2 and FIG. 3 are perspective views of a portion of a structure of the dishwasher in accordance with one embodiment of the present disclosure.

A dishwasher 1 includes a cabinet 10 forming an exterior appearance, a washing tub 12 provided at an inside the cabinet 10, tableware baskets 14*a* and 14*b* provided at an inside of the washing tub 12 and configured to store tableware, a sump 20 configured to gather and store wash water, and spray units 41, 42, and 43 to spray the wash water.

The washing tub 12 is formed in the approximate shape of a box, and is provided with a front having an opening as to insert/withdraw tableware. The open front of the washing tub 12 may be open/closed by use of a door 11. The door 11 may be rotatably coupled into the cabinet 10.

The tableware baskets 14*a* and 14*b* may include an upper tableware basket 14*a* and a lower tableware basket 14*b*. The upper tableware basket 14*a* may be supported at an upper rack 13*a*, and the lower tableware basket 14*b* may be supported at a lower rack 13*b*. The upper tableware basket 14*a* and the lower tableware basket 14*b* may be provided at an inside the washing tub 12 as to be slided forward/backward.

A washing pump 21 to pump stored water to the spray units 41, 42, and 43 may be provided at the sump 20. The wash water being pumped by use of the washing pump 21 is supplied to a first spray unit 41 and a second spray unit 42 through a first supplying pipe 31, or may be supplied to a third spray unit 43 through a second supplying pipe 32.

In addition, a heater 15 configured to heat the wash water, as well as a draining pump 22 configured to drain the wash water, may be provided at a lower portion of the washing tub 12.

Meanwhile, as illustrated on FIG. 1, the first spray unit 41 is provided at an upper side of the upper tableware basket 14*a*, the second spray unit 42 is provided in between the upper tableware basket 14*a* and the lower tableware basket 14*b*, and the third spray unit 43 is provided below the lower tableware basket 14*b*.

In addition, the first spray unit 41 is provided as to rotate while having a rotational axis 41*a*, and the second spray unit 42 may be provided as to rotate while having a rotational axis 42*a*.

The first spray unit 41 is able to spray the wash water toward tableware stored at the upper tableware basket 14*a*, and the second spray unit 42 is able to spray the wash water toward tableware stored at the upper tableware basket 14*a* and the lower tableware basket 14*b*.

Meanwhile, the third spray unit 43, differently from the first spray unit 41 and the second spray unit 42, may be fixedly provided at one side of the washing tub 12. The third spray unit 43 is configured to spray the wash water approximately toward a parallel direction, and thus the wash water sprayed form the third spray unit 43 may not directly face toward the tableware.

The third spray unit 43 may be structured with a plurality of nozzles 44*a* and 44*b* through which the wash water is sprayed, and a plurality of heads 45*a* and 45*b* to supply the wash water to the plurality of nozzles 44*a* and 44*b*. The plurality of nozzles 44*a* and 44*b* each is approximately spaced apart by a predetermined distance from one side surface to an opposite side surface of the washing tub, and may be arranged in line.

The plurality of heads 45*a* and 45*b* may include a left head 45*a* and a right head 45*b*, and the nozzle 44*a* is provided at the left head 45*a* while the nozzle 44*b* may be provided at the right head 45*b*.

The second supplying pipe 32 may be divided into a supplying pipe 32*a* to supply the wash water to the left head 45*a*, and a supplying pipe 32*b* to supply the wash water to the right head 45*b*.

The wash water sprayed approximately toward a parallel direction from the nozzles 44*a* and 44*b* of the third spray unit 43 is direction-converted by use of the conversion assembly disposed at an inside the washing tub 12, and may move forward toward the tableware stored at the lower tableware basket 14*b*.

Hereinafter, for the convenience of description, the third spray unit 43 is defined as a spray unit 120.

Figure 4:
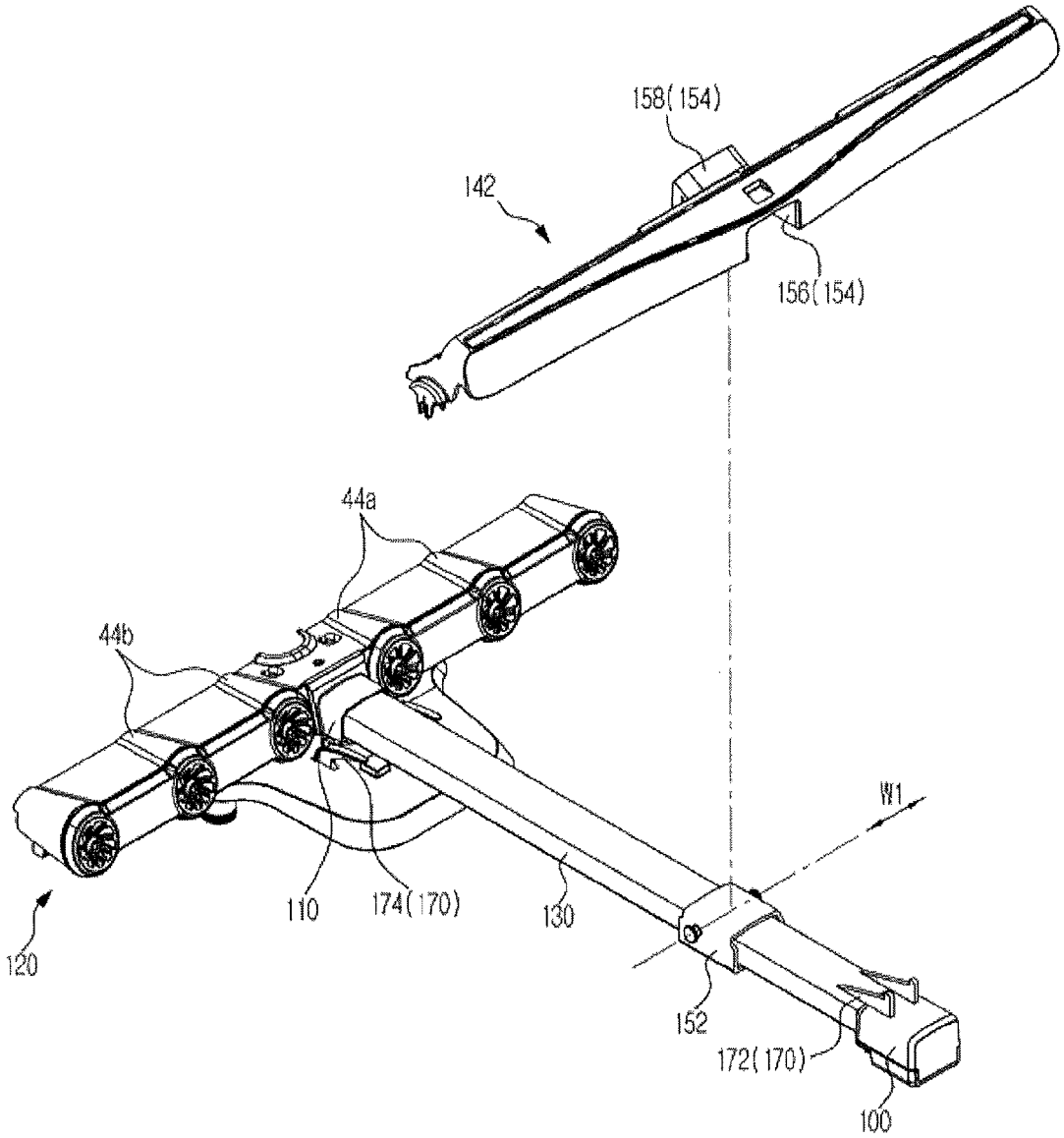
FIG. 4 is an exploded perspective view of a portion of a structure of the dishwasher in accordance with one embodiment of the present disclosure.
Figure 5:
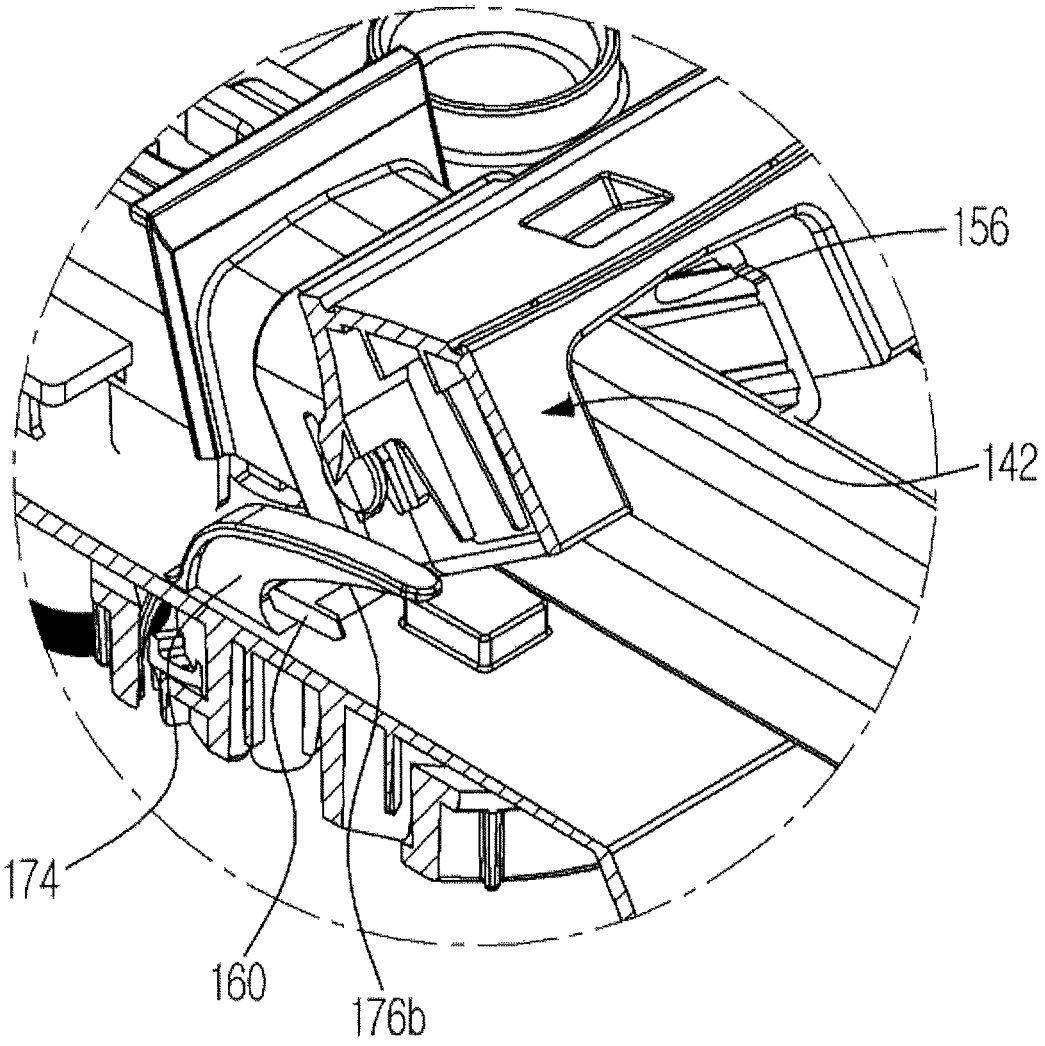
FIG. 5 and FIG. 6 are drawings with respect to movements of a conversion assembly in a first section in accordance with one embodiment of the present disclosure.
Figure 6:
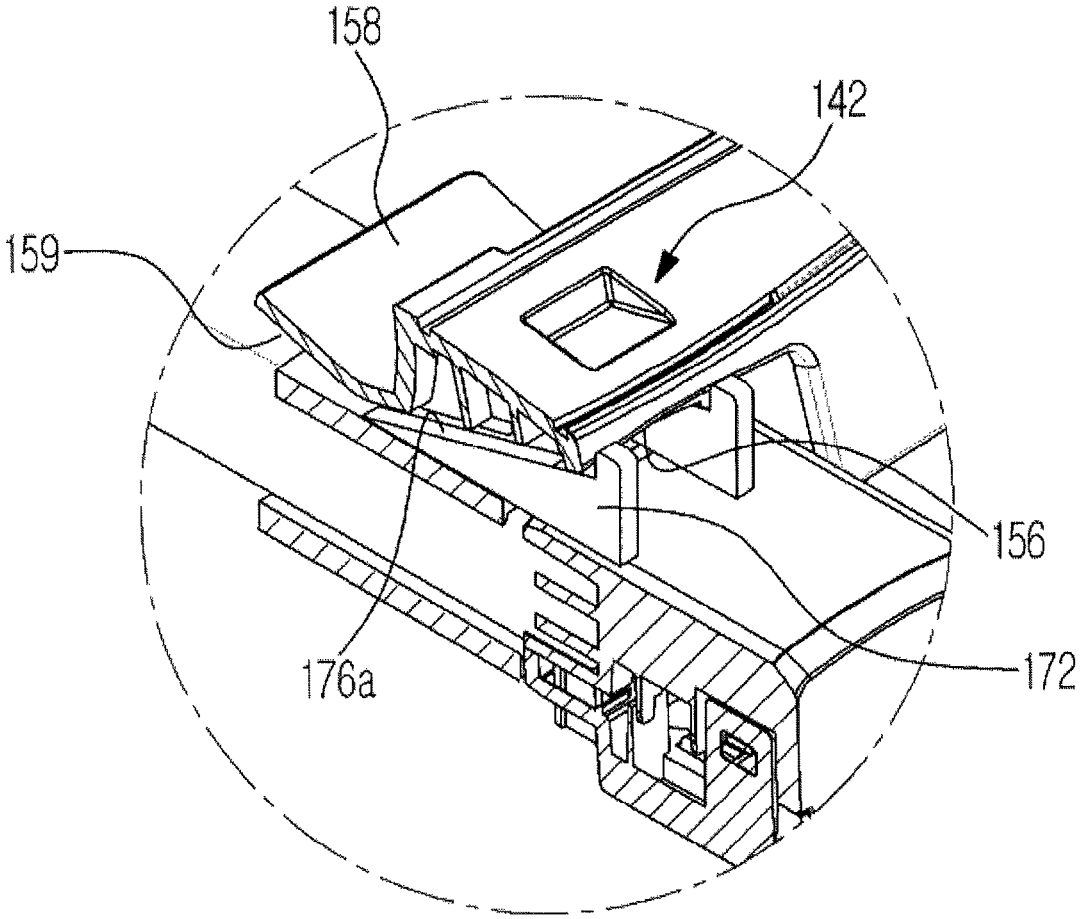

FIG. 4 is an exploded perspective view of a portion of a structure of the dishwasher in accordance with one embodiment of the present disclosure, and FIG. 5 and FIG. 6 are drawings with respect to movements of a conversion assembly in a first section in accordance with one embodiment of the present disclosure.

A conversion assembly 140 is provided as to convert the direction of the wash water sprayed from the spray unit 120. The conversion assembly 140 is correspondingly provided with respect to the spray unit 120 such that the direction of the wash water sprayed from the spray unit 120 is converted toward the lower tableware basket 14*b*.

The conversion assembly 140, while provided at least at one certain side of a upper side or lower side of the lower tableware basket 14*b*, is provided as to wash the tableware at an inside the lower tableware basket 14*b* by converting the direction of the wash water sprayed from the spray unit 120.

The conversion assembly 140 may include a vane 142.

The vane 142 is provided as to convert the direction of the wash water sprayed from the spray unit 120, and may be correspondingly provided with respect to the spray unit 120. The vane 142 may be extendedly from in lengthways along the direction of disposition of the spray unit 120 such that the direction of the wash water sprayed from the spray unit 120 may be entirely converted.

The vane 142 may include a direction converting surface 142*a* as to convert the moving direction of the wash water. The direction converting surface 142*a* is concavely formed, such that the direction of wash water may be converted without reacting at the time of when the wash water is in contact with the direction converting surface 142*a*. The shape of the direction converting surface 142*a* may be identically formed in lengthways, and may also be provided while having the degree of bending varied along the lengthways direction.

A roller 144 configured to balance the vane 142 may be provided at each of both end portions of the lengthways direction of the vane 142. The roller 144 may be supported by use of a supporting rail (not shown) provided at the washing tub 12.

The vane 142 is provided as to axially rotate with respect to a first axis direction 'w1', which is lengthways direction. In the embodiments of the present disclosure, an embodiment in which an upper end of the vane 142 is rotated toward a first rotating direction 'r1' as to face a rear of the cabinet 10 is presented. However, the upper end of the vane 142 may be rotated toward a second rotating direction 'r2' as to face a rear of the cabinet 10.

The vane 142 is axially rotated while having the first axis direction 'w1' as a center by use of a rotation guide 170, which is to be described later, while moving on a guide rail 130, but is not limited hereto, and the conversion assembly 140 having a power source (not shown) may be rotatably provided while supplied with a rotational force from the power source as the vane 142 is moved on the guide rail 130.

The conversion assembly 140 may further include a holder 150 provided as to move or rotate the vane 142. The holder 150 is provided as to support the vane 142 at the guide rail 130, and may include a guide holder 152 and a vane holder 154.

The guide holder 152 is provided such that the vane 142 is moved along the guide rail 130. In detail, when the lengthways direction of the vane 142 is referred to as the first axis direction 'w1', the guide rail 130 may be provided such that the vane 142 is able to parallelly move toward a second direction 'w2' that is perpendicular with respect to the first axis direction 'w1'. The guide rail 130 is provided such that the conversion assembly 140 is moved back and forth on the guide rail 130, and may be able to extend the spraying range of the wash water facing toward the lower tableware basket 14*b*. The vane 142, while axially rotated simultaneously by having the first axis direction 'w1' as a center, may be provided to be parallelly moved toward the second direction 'w2' along the guide rail 130.

The vane 142 is mounted at the vane holder 154, and is rotatably provided while having the first axis direction 'w1' as a center. The vane holder 154 may be separately formed with respect to the vane 142, and in the embodiment of the present disclosure, the vane holder 154 and the vane 142 are integrally formed.

The vane holder 154 is rotatably coupled into a guide holder 152, and by use of the structure as such, is rotatably provided along with the vane 142.

The vane holder 154 includes a front vane holder 156 disposed at a front of the vane 142, and a rear vane holder 158 disposed at a rear of the vane 142, and may be provided to be pressed by use of a rotation guide 170, which is to be described later. In detail, the vane holder 154 may include the front vane holder 156 pressed by use of a first rotation guide 172, and the rear vane holder 158 pressed by use of a second rotation guide 174.

The rear vane holder 158 is corresponded with respect to an upper surface of the guide rail 130, and may include a rotation guide surface 159 being open by a predetermined angle with respect to the guide rail 130, such that the guide rail 130 is not interfered by the rear vane holder 158 at the time of when the conversion assembly 140 is rotated toward the first rotating direction 'r1'. The angle that is formed by the guide rail 130 and the rotation guide surface 159 is not limited, and may be applied differently according to the degree of axial rotation of the vane 142.

In addition, as the rear vane holder 158 may be interfered with respect to the guide rail 130 at the time of when rotating toward the rotation guide surface 159, the portion corresponding to the rotation guide 170 may be disposed at a side surface of the guide rail 130. That is, the rear vane holder 158 is pressed by use of the second rotation guide 174, and may include a non-pressing bump 160 disposed at a side surface of the guide rail 130.

A lower portion of the vane holder 154 may be provided to be open, as to prevent the vane holder 154, which is rotating while having the first rotating direction 'r1' as a center, from being interfered at the guide rail 130 and the guide holder 152.

In the embodiment of the present disclosure, the holder 150 configured to support the vane 142 at the guide rail 130 is provided as to parallelly move or axially rotate with respect to the lengthways of the vane 142, while the holder 150 may also be provided as to rotate while having the holder 150 as a center.

The rotation guide 170 is provided such that the vane 142 is rotated while having the first axis direction 'w1' as a center.

In detail, the rotation guide 170 is provided such that, by pressing the vane holder 154 of the conversion assembly 140, the vane 142 is axially rotated while having the first axis direction 'w1' as a center.

The rotation guide 170 may be provided, while disposed at an end portion of the guide rail 130, as to press the conversion assembly 140 at a time when the conversion assembly 140 is moved toward the end portion of the guide rail 130. For example, in the embodiment of the present disclosure, the rotation guide 170 is disposed at each of the end portions of the guide rail 130, as shown in FIG. 4. However, the current disclosure is not limited to this disposition and may include the rotation guide 170 being disposed at other portions of the guide rail 130 to press the conversion assembly 140 at a desired location to axially rotate the vane 142.

The rotation guide 170 may include a first rotation guide 172 disposed at one end portion of the guide rail 130, and a second rotation guide 174 disposed at the other end portion of the guide rail 130.

In detail, a first rail supporting unit 100 configured to support the one end portion of the guide rail 130 is provided at the one end portion of the guide rail 130, and a second rail supporting unit 110 disposed at a side of the spray unit 120 and configured to support the other end portion of the guide rail 130 is provided, and the first rotation guide 172 is disposed on the first rail supporting unit 100 while the second rotation guide 174 is provided on the second rail supporting unit 110.

The rotation guide 170 may include rotating inclination surfaces 176*a* and 176*b* configured to press the conversion assembly 140 such that the vane 142 is axially rotated while having the first axis direction 'w1' as a center. The degrees of inclination of the rotating inclination surfaces 176*a* and 176*b* are not limited, and in the embodiments of the present disclosure, the rotating inclination surfaces 176*a* and 176*b* are formed as to form gradual degrees as to prevent the vane 142 from rapidly rotated.

Figure 7:
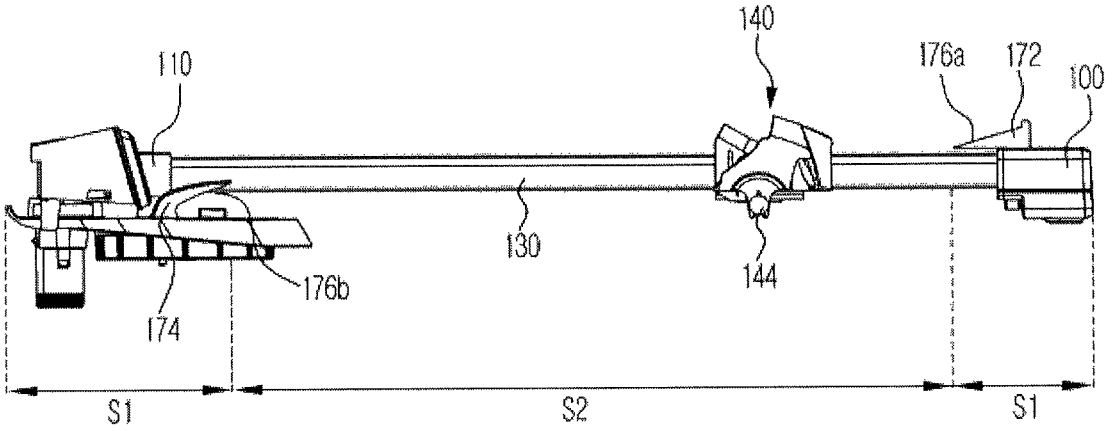
FIG. 7 is a cross-sectional view of a spraying structure of wash water in accordance with one embodiment of the present disclosure.
Figure 8A:
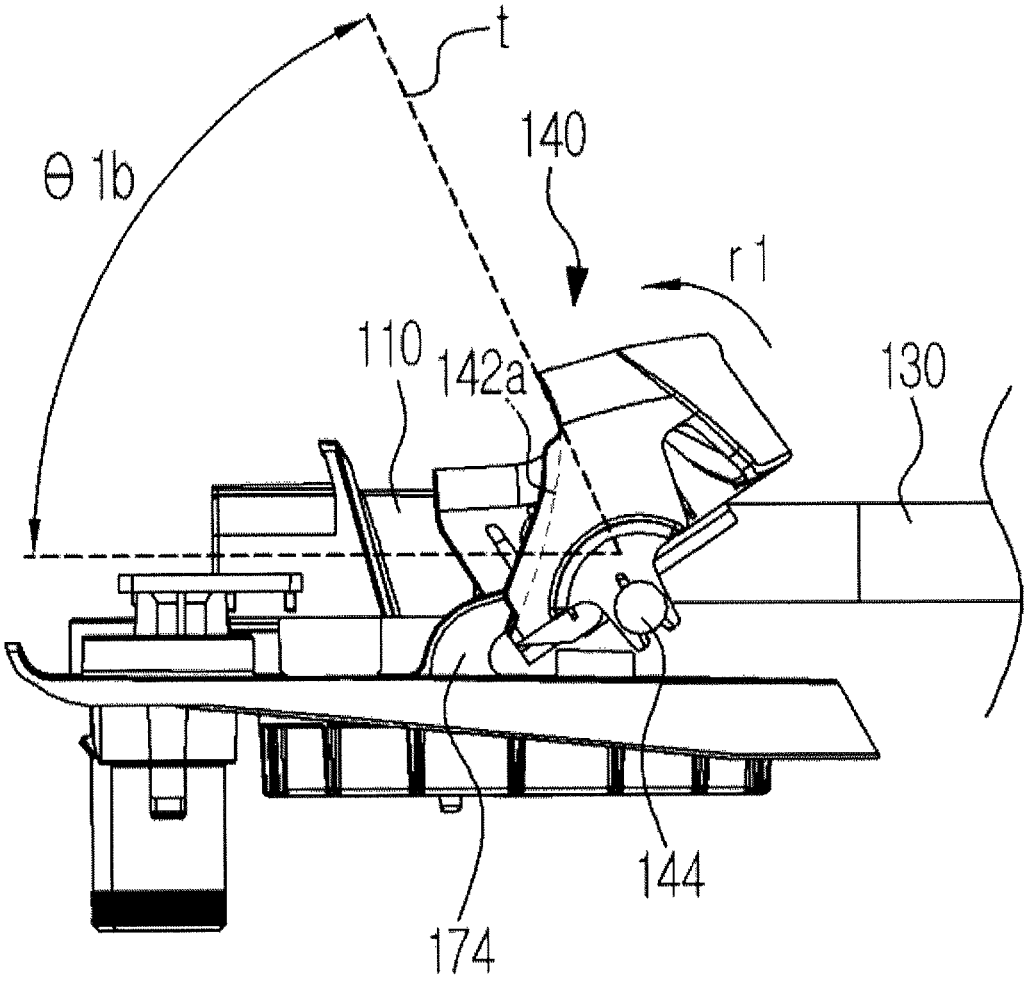
FIG. 8A and FIG. 8B are cross-sectional views with respect to dispositions of the conversion assembly in the first section in accordance with one embodiment of the present disclosure.
Figure 8B:
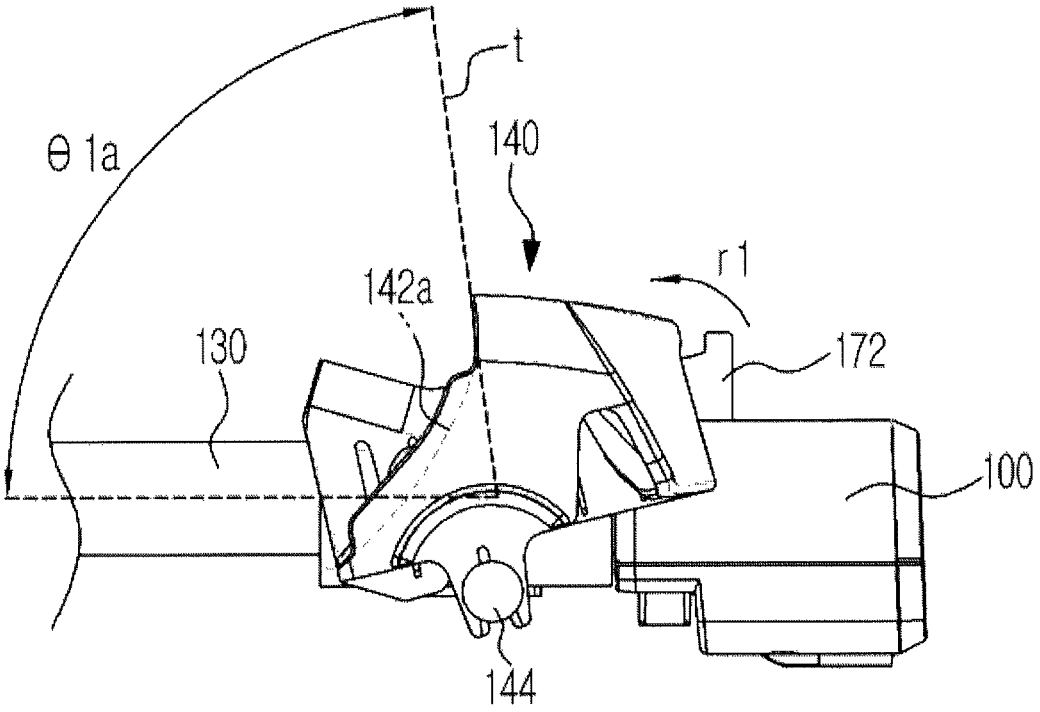
Figure 9:
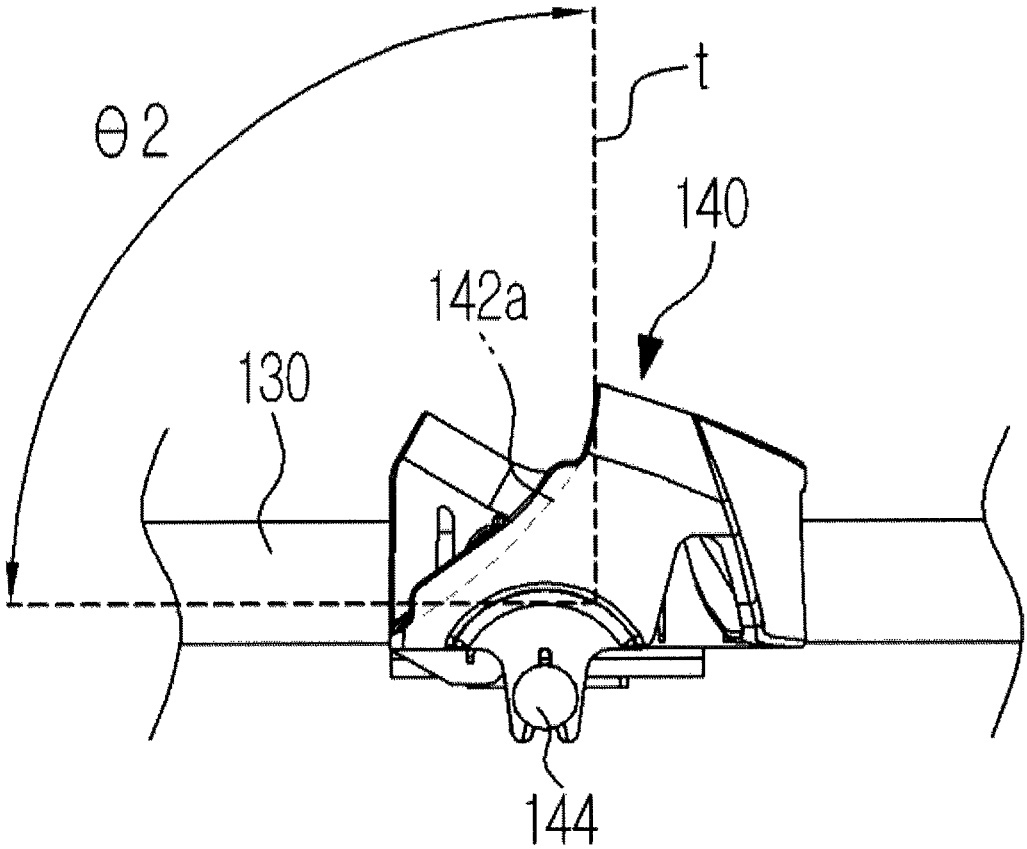
FIG. 9 is a cross-sectional view with respect to a disposition of the conversion assembly in the second section in accordance with one embodiment of the present disclosure.

FIG. 7 is a cross-sectional view of a spraying structure of the wash water in accordance with one embodiment of the present disclosure, FIG. 8A and FIG. 8B are cross-sectional views with respect to dispositions of the conversion assembly in the first section in accordance with one embodiment of the present disclosure, and FIG. 9 is a cross-sectional view with respect to a disposition of the conversion assembly in the second section in accordance with one embodiment of the present disclosure.

The conversion assembly 140 is provided as to move along the guide rail 130.

An angle 'θ' that is formed by the contact lines of upper portions of the guide rail 130 and the direction converting surface 142*a* may be provided as to be changed according to the positions of the conversion assembly 140. That is, the vane 142 is provided as to rotate toward the first rotating direction 'r1' by use of the rotation guide 170, and thus the angle that is formed by the direction converting surface 142*a* of the vane 142 and the guide rail 130 is changed.

The guide rail 130 includes a first section 'S1', which is a section in which the conversion assembly 140 is rotated while having the first axis direction 'w1' as a center by use of the rotation guide 170, and a second section 'S2', which is a section that is other than the first section 'S1'. If the angle that is formed by a contact line 't' of an upper portion of the direction converting surface 142*a* and the guide rail 130 in the first section 'S1' is referred to as a 'θ1', and the angle that is formed by the contact line 't' of an upper portion of the direction converting surface 142*a* and the guide rail 130 in the second section 'S2' is referred to as a 'θ2', the 'θ1' may be formed less than the 'θ2'. That is, at the time of when the vane holder 154 is rotated toward the first rotating direction 'r1' while gradually pressed by use of the rotation guide 170, the angle 'θ' formed by the direction converting surface 142*a* and the guide rail 130 is formed to be gradually smaller.

In addition, even in a case of the first section 'S1', an angle 'θ1*a*' at which the conversion assembly 140 is rotated by use of the first rotation guide 172 may be differently structured with respect to an angle 'θ1*b*' at which the conversion assembly 140 is rotated by use of the second rotation guide 174.

The dispositions of the first section 'S1' and the second section 'S2' are not limited. However, in the embodiment of the present disclosure, the rotation guide 170 is disposed at the each of the both end portions of the guide rail 130, and thus the first section 'S1' may be provided as to be disposed at each of both end portions of the second section 'S2'.

The relationships between the conversion assembly 140 and the rotation guide 170 in the first section 'S1' will be described. The conversion assembly 140 is rotated by use of the rotation guide 170 in the first section 'S1'.

The first rotation guide 172 is provided at the first rail supporting unit 100, and may include the first rotating inclination surface 176*a* inclinedly provided toward an ascended direction with respect to the moving direction of the conversion assembly 140.

The first rotating inclination surface 176*a* is provided to rotate the vane 142 along with the vane holder 154 toward the first rotating direction 'r1' by pressing an inner side surface of the front vane holder 156.

The second rotation guide 174 is provided at the second rail supporting unit 110, and may include the second rotating inclination surface 176*b* inclinedly provided toward an descended direction with respect to the moving direction of the conversion assembly 140.

The second rotating inclination surface 176*b* is provided to rotate the vane 142 along with the vane holder 154 toward the first rotating direction 'r1' by pressing the non-pressing bump 160 of the rear vane holder 158.

The 'θ1' is gradually decreased as the conversion assembly 140 is moved toward end portion of the guide rail 130 by use of the first rotating inclination surface 176*a* or the second rotating inclination surface 176*b* in the first section 'S1'.

The conversion assembly 140 is not pressed by the rotation guide 170 in the second section 'S2', and thus the 'θ2', which is the angle formed by the direction converting surface 142*a* and the guide rail 130, is constantly maintained.

Hereinafter, the movements according to the structure of the dishwasher described above will be described.

Figure 10:
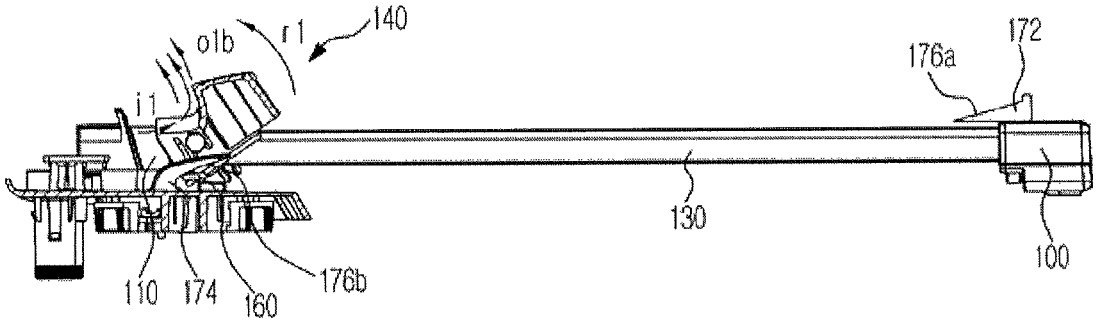
FIG. 10 and FIG. 11 are drawings with respect to directions of water currents in the first section in accordance with one embodiment of the present disclosure.
Figure 11:
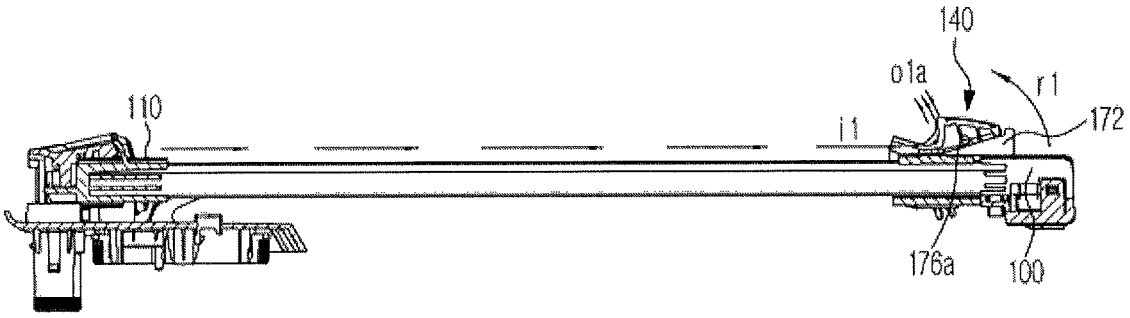
Figure 12:
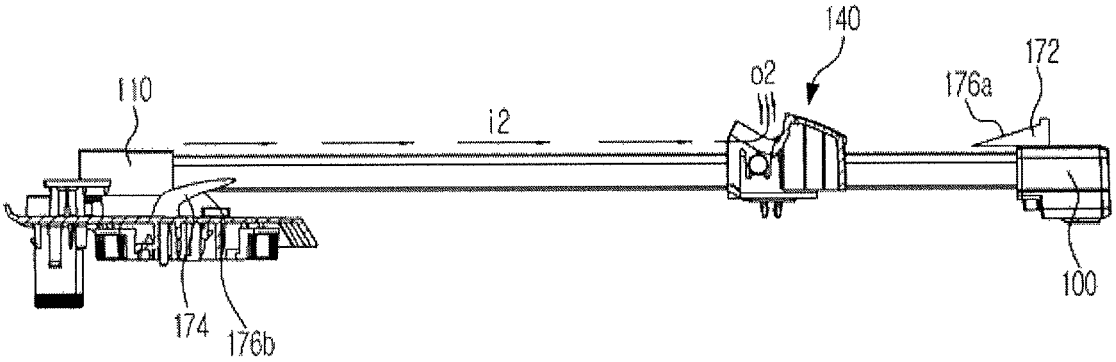
FIG. 12 is a drawing with respect to directions of water current in the second section in accordance with one embodiment of the present disclosure.

FIG. 10 and FIG. 11 are drawings with respect to directions of water currents in the first section in accordance with one embodiment of the present disclosure, and FIG. 12 is a drawing with respect to directions of water current in the second section in accordance with one embodiment of the present disclosure.

First, the movements of the conversion assembly 140 at the guide rail 130 in the second section 'S2' will be described.

The conversion assembly 140 moved in the second section 'S2', since the vane 142 is parallelly moved without rotating, and thus the wash water sprayed from the spray unit 120 is provided to be converted toward the lower tableware basket 14*b* after passing through the vane 142.

That is, a wash water 'i2' facing toward the vane 142 at the spray unit 120 is direction-converted into a wash water 'o2' facing toward the lower tableware basket 14*b* after passing through the vane 142.

Since the conversion assembly 140 moved in the first section 'S1' is rotated toward the first rotating direction 'r1' by use of the rotation guide 170, the wash water sprayed from the spray unit 120 is provided to be direction-converted toward the lower tableware basket 14*b* after passing through the rotating vane 142.

That is, a wash water 'i1' facing toward the vane 142 at the spray unit 120 is direction-converted into a wash water 'o1' facing toward the lower tableware basket 14*b* after passing through the vane 142.

In detail, the door 11 is not struck by the direction-converted wash water in a case when rotating toward the first rotating direction 'r1' by use of the first rotation guide 172, and thus the noise of strike of the water current with respect to an inside the cabinet 10 or the door 11 may be able to be reduced.

In addition, in a case when rotating toward the first rotating direction 'r1' by use of the second rotation guide 174, the wash water that is direction-converted may be able to be sprayed to a rear of the cabinet 10, and thus the spraying range of the wash water may be further extended.

In addition, even in a case of the first section 'S1', the 'θ1*a*' at which the conversion assembly 140 is rotated by use of the first rotation guide 172 may be differently structured with respect to the 'θ1*b*' at which the conversion assembly 140 is rotated by use of the second rotation guide 174, and thus the direction of the wash water facing toward the lower tableware basket 14*b* through the vane 142 may be provided such that the case of being rotated by use of the first rotation guide 172 and the case of being rotated by use of the second rotation guide 174 may be different with respect to each other.

That is, a direction 'o1*a*' of the wash water of the conversion assembly 140 being rotated by use of the first rotation guide 172 may be provided differently with respect to a direction 'o1*b*' of the wash water of the conversion assembly 140 being rotated by use of the second rotation guide 174.

Hereinafter, another embodiment with respect to a dishwasher of the present disclosure will be described. The structures that are identical with respect to the one embodiment described above will be omitted.

Figure 13:
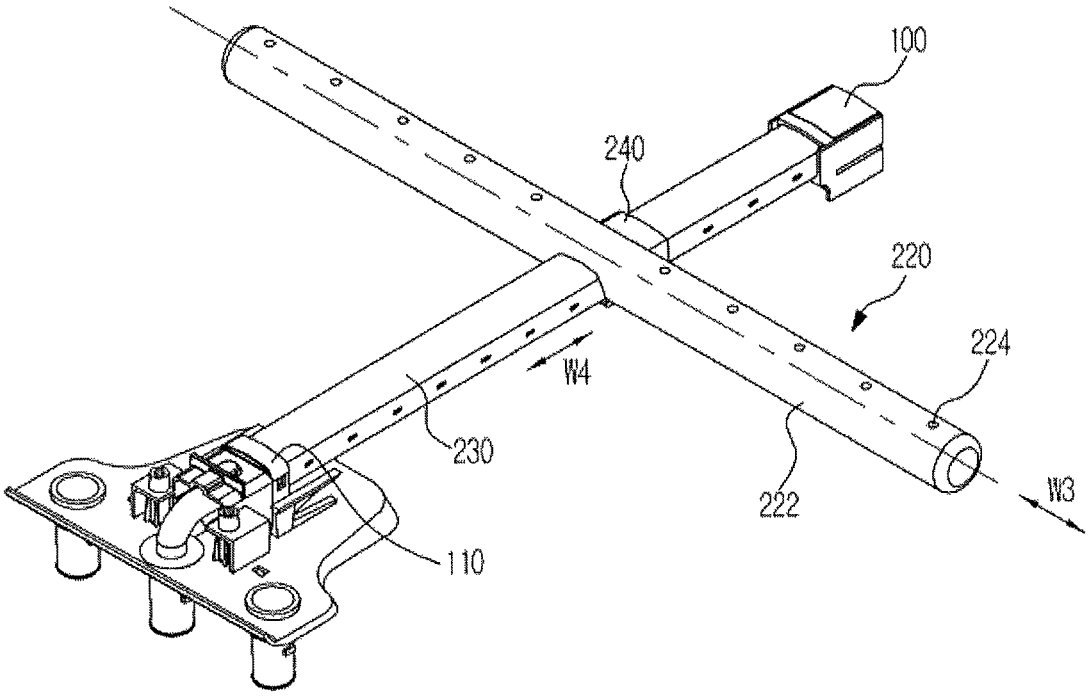
FIG. 13 is a perspective view of a spraying structure of wash water in accordance with another embodiment of the present disclosure.

FIG. 13 is a perspective view of a spraying structure of wash water in accordance with another embodiment of the present disclosure.

In the embodiment, the dishwasher 1 includes the spray unit 220, the guide rail 230, and the conversion assembly 240.

The spray unit 220 is movably provided while spraying wash water toward the lower tableware basket 14*b*. In the one embodiment of the present disclosure, the tableware is washed by direction-converting the wash water, which is sprayed from the spray unit 120, by use of the conversion assembly 140. However, in the embodiment of the present disclosure, the spray unit 220 is movably provided as to directly wash the tableware.

The shape of the spray unit 220 is not limited, and in the embodiment of the present disclosure, the spray unit 220 is provided with the spraying unit body 222 extendedly formed in lengthways, and is also provided with the plurality of wash water spraying units 224.

The guide rail 230 is provided as to guide the movements of the spray unit 220, such that the spray unit 220 may be moved. The guide rail 230 may be identical with respect to the structure of the one embodiment.

The conversion assembly 240 is provided such that the spray unit 220 is moved along the guide rail 230, and is also provided such that the spray unit 220 may be axially rotated. In detail, the conversion assembly 240 is provided as to be axially rotated with respect to a third axis direction 'w3', which is the lengthways direction of the spray unit 220, and is configured to guide the movements to be parallelly moved toward the fourth axis direction 'w4', which is perpendicular with respect to the third axis direction 'w3'.

Through the structure as such, the spraying range may be extended through the rotations and movements of the spray unit 220, and the blind areas of the spraying range may be minimized.

In accordance with the present disclosure, a dishwasher is capable of improving efficiencies in washing tableware by extending the spraying range of wash water, and also capable of improving efficiencies in spraying wash water as spraying angle of the wash water is adjusted. In addition, the noise of strike due to the structure of spray wash water, as well as the noise of strike by water current, can be reduced, and thereby washing performance can be improved.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher, comprising:

a cabinet forming an exterior appearance of the dishwasher;

a washing tub provided at an inside of the cabinet and at which washing of tableware is taken place;

a tableware basket configured to store the tableware at an inside the washing tub;

a spray unit fixed to the washing tub and configured to spray wash water;

a conversion assembly provided as to convert a direction of the wash water being sprayed from the spray unit toward the tableware basket; and a guide rail configured to guide movement of the conversion assembly, wherein the conversion assembly comprises:

a guide holder provided to move along the guide rail, a vane holder provided at the guide holder as to be axially rotated, and a vane, mounted at the vane holder such that the vane and vane holder are rotated together with rotation of the vane holder, and disposed as to face the spray unit such that a direction of the wash water converted is adjusted.

2. The dishwasher of claim 1, wherein:

the vane is formed in a first axis direction, which is lengthways direction, and is provided as to axially rotate on the first axis.

3. The dishwasher of claim 2, wherein the vane is parallelly moved in a second direction that is perpendicular to the first axis.

4. The dishwasher of claim 3, wherein:

the vane is provided so as to simultaneously perform an axial rotation while having the first direction as a center of rotation and a parallel movement in the second direction.

5. The dishwasher of claim 1, wherein:

the vane includes a direction converting surface concaved at a surface of the vane making contact with wash water so as to convert the direction of wash water sprayed from the spray unit toward the tableware basket.

6. The dishwasher of claim 5, wherein:

an angle θ formed between the guide rail and the direction converting surface varies with a position of the conversion assembly.

7. The dishwasher of claim 3, further comprising:

rotation guides provided at both end portions of the guide rail such that the vane is axially rotated on the first axis.

8. The dishwasher of claim 7, wherein:

the guide rail comprises:

a first section, which is a section in which the conversion assembly is rotated on the first axis by the rotation guides; and a second section, which is the remaining section, wherein an angle formed between the guide rail and the vane is referred to as θ1 in the first section, and referred to as θ2 in the second section, wherein θ1 is smaller than θ2.

9. The dishwasher of claim 8, wherein:

the first section is disposed at each of end portions of the second section.

10. The dishwasher of claim 7, wherein:

the rotation guides comprise a rotating inclination surface configured to press the conversion assembly such that the vane is axially rotated on the first axis in a gradual manner.

11. The dishwasher of claim 7, wherein:

the rotation guides comprise a first rotation guide disposed at one end portion of the guide rail; and a second rotation guide disposed at the other end portion of the guide rail.

12. The dishwasher of claim 7, wherein:

the vane holder is provided so as to rotate on the first axis; and the rotation guides are configured to allow the vane to axially rotate on the first axis by pressing the vane holder.

13. The dishwasher of claim 12, wherein:

the guide holder is provided such that the vane is moved in the second direction along the guide rail; and the vane holder is coupled to the guide holder so as to rotate on the first axis.

14. The dishwasher of claim 11, wherein:

the vane holder is provided to be rotated on the first axis, and the vane holder comprises a front vane holder corresponding to the first rotation guide and disposed at a front of the vane, and a second vane holder corresponding to the second rotation guide and disposed at a rear of the vane.

15. The dishwasher of claim 14, wherein:

the first rotation guide comprises a first inclination surface which is inclined with respect to a moving direction of the vane such that the front vane holder ascends as the vane travels; and the second rotation guide comprises a second inclination surface which is inclined with respect to the moving direction of the vane such that the rear vane holder descends as the vane travels.

16. The dishwasher of claim 11, further comprising:

a door configured to open/close an opening of the cabinet, wherein the first rotation guide is configured to rotate the vane in a first rotating direction while having an upper end of the vane inclined toward a rear, such that the door is prevented from being struck by the wash water being sprayed from the spray unit.

17. The dishwasher of claim 16, wherein:

the second rotation guide is configured to rotate the vane in the first rotating direction such that the spraying range of the wash water being sprayed from the spray unit is widened.

18. The dishwasher of claim 1, wherein:

the conversion assembly is provided on at least one of an upper side or lower side of the tableware basket as to convert the direction of the wash water being sprayed from the spray unit toward the tableware basket.

19. A dishwasher, comprising:

a cabinet forming an exterior appearance of the dishwasher;

a washing tub provided at an inside the cabinet and at which washing of tableware is taken place;

a spray unit fixed to the washing tub and configured to spray wash water;

a conversion assembly provided to rotate on a first axis, having a vane provided to face the spray unit such that the direction of the wash water being sprayed from the spray unit is converted, and movably provided;

a guide rail provided such that the conversion assembly is moved in a second direction that is perpendicular to the first axis; and rotation guides capable of rotating the vane on the first axis, wherein the conversion assembly comprises:

a guide holder provided to move along the guide rail, a vane holder provided at the guide holder as to be axially rotated on the first axis, and the vane, mounted at the vane holder such that the vane and vane holder are rotated together with rotation of the vane holder on the first axis.

20. The dishwasher of claim 19, wherein:

the rotation guides, while disposed at one end portion of the guide rail, are configured to allow the conversion assembly to rotate on the first axis in a case when the conversion assembly is moved toward the one end portion of the guide rail.

21. The dishwasher of claim 19, wherein:

the guide holder is provided such that the vane is moved in the second direction, and configured to support the vane holder.

22. The dishwasher of claim 19, wherein:

the vane comprises a direction converting surface configured to convert the direction of the wash water sprayed from the spray unit; and the direction converting surface is inclinedly provided toward a rear of the washing tub by the rotation guides.

23. The dishwasher of claim 22, wherein:

the guide rail comprises:

a first section, which is a section in which the conversion assembly is moved in between the rotation guides; and a second section, which is a section in which the conversion assembly is moved while being rotated on the first axis by the rotation guides, wherein an angle $\theta 1$ formed between the direction converting surface and the guide rail in the first section is larger than an angle $\theta 2$ between the direction converting surface and the guide rail in the second section.

24. The dishwasher of claim 23, wherein:

the second section is disposed at each of both end portions of the first section.

25. The dishwasher of claim 19, wherein the rotation guides comprise:

a first rotation guide disposed at one end portion of the guide rail; and a second rotation guide disposed at the other end portion of the guide rail.

26. A dishwasher, comprising:

a cabinet forming an exterior appearance of the dishwasher;

a washing tub provided at an inside the cabinet and at which washing of tableware is taken place;

a spray unit fixed to the washing tub and configured to spray wash water;

a conversion assembly movably provided and disposed while facing the spray unit such that the direction of the wash water being sprayed from the spray unit is converted; and a guide rail configured to guide movement of the conversion assembly, wherein the conversion assembly includes a guide holder provided to move along the guide rail;

a vane holder provided at the guide holder as to be axially rotated; and a vane mounted at the vane holder and provided to be rotated together with rotation of the vane holder.

27. A dishwasher, comprising:

a cabinet forming an exterior appearance of the dishwasher;

a washing tub provided at an inside the cabinet and at which washing of tableware is taken place;

a tableware basket configured to store the tableware at an inside the washing tub;

a spray unit provided to move while spraying wash water toward the tableware basket;

a guide rail configured to guide movement of the spray unit; and a conversion assembly configured to support the spray unit such that the spray unit is moved along the guide rail, and configured to rotatably support the spray unit such that the spray unit is rotated while having a length direction as a center of rotation.

28. A dishwasher, comprising:

a spray unit fixed to an inside of the dishwasher and configured to spray wash water;

a conversion assembly provided as to convert a direction of the wash water being sprayed from the spray unit to another direction; and a guide rail configured to guide movement of the conversion assembly, wherein the conversion assembly comprises:

a guide holder provided to move along the guide rail, a vane holder provided at the guide holder as to be axially rotated, and a vane, mounted at the vane holder such that the vane and vane holder are rotated together with rotation of the vane holder, and disposed as to face the spray unit such that the direction of the wash water converted is adjusted.

29. A dishwasher, comprising:

a spray unit provided to move while spraying wash water toward an object within the dishwasher;

a guide rail configured to guide movement of the spray unit; and a conversion assembly configured to support the spray unit such that the spray unit is moved along the guide rail, and configured to rotatably support the spray unit such that the spray unit is rotated while having a length direction as a center of rotation.

* * * * *